US011805573B2

(12) United States Patent
Zoppas et al.

(10) Patent No.: US 11,805,573 B2
(45) Date of Patent: Oct. 31, 2023

(54) FLEXIBLE RESISTOR

(71) Applicant: I.R.C.A. S.P.A. INDUSTRIA RESISTENZE CORAZZATE E AFFINI, Vittorio Veneto (IT)

(72) Inventors: Federico Zoppas, Treviso (IT); Stefano Zanella, Montebelluna (IT); Sandro Marcer, Conegliano (IT); Mario Eusebio, Pordenone (IT)

(73) Assignee: I.R.C.A. S.P.A. INDUSTRIA RESISTENZE CORAZATTE E AFFINI, Vittorio Veneto (IT)

( * ) Notice: Subject to any disclaimer, the term of this patent is extended or adjusted under 35 U.S.C. 154(b) by 903 days.

(21) Appl. No.: 16/620,978

(22) PCT Filed: Jun. 13, 2018

(86) PCT No.: PCT/IB2018/054308
§ 371 (c)(1),
(2) Date: Dec. 10, 2019

(87) PCT Pub. No.: WO2018/229674
PCT Pub. Date: Dec. 20, 2018

(65) Prior Publication Data

US 2020/0100330 A1 Mar. 26, 2020

(30) Foreign Application Priority Data

Jun. 13, 2017 (IT) ..... 102017000065507

(51) Int. Cl.
*H05B 1/02* (2006.01)
*F02B 47/02* (2006.01)
(Continued)

(52) U.S. Cl.
CPC ..... *H05B 1/0297* (2013.01); *F02B 47/02* (2013.01); *H01C 1/01* (2013.01); *H01C 1/02* (2013.01); *H01C 10/10* (2013.01); *H01C 17/00* (2013.01); *H05B 3/82* (2013.01); *F01N 2610/00* (2013.01); *F01N 2610/10* (2013.01);
(Continued)

(58) Field of Classification Search
CPC . H01C 1/01; H01C 1/02; H01C 10/10; H01C 17/00; F01N 2610/1406; H05B 2203/02; H05B 3/36
See application file for complete search history.

(56) References Cited

U.S. PATENT DOCUMENTS 6,181,234 B1 * 1/2001 Szwarc ..... H01C 1/144 338/53
2013/0043017 A1 2/2013 Kim et al.

FOREIGN PATENT DOCUMENTS

EP 1859651 B1 11/2007
JP 58101491 A 7/1983
(Continued)

*Primary Examiner* — Lionel Nouketcha
(74) *Attorney, Agent, or Firm* — AMSTER ROTHSTEIN & EBENSTEIN LLP

(57) ABSTRACT

A flexible resistor including a support made of electrically insulating material; at least one track made of an electrically conductive material incorporated in the support, and configured to be connected to an electric energy source; a foil made of electrically conductive material, having a surface fixed to a first face of the support, and a plurality of wings defined by foil portions cut and folded transversally to the surface.

15 Claims, 2 Drawing Sheets

(51) Int. Cl.

| | |
|---|---|
| ***H01C 1/01*** | (2006.01) |
| ***H01C 1/02*** | (2006.01) |
| ***H01C 10/10*** | (2006.01) |
| ***H01C 17/00*** | (2006.01) |
| ***H05B 3/82*** | (2006.01) |

(52) U.S. Cl.
CPC .. *F01N 2610/1406* (2013.01); *H05B 2203/02* (2013.01); *H05B 2203/021* (2013.01)

(56) References Cited

FOREIGN PATENT DOCUMENTS

| | | | |
|---|---|---|---|
| JP | 6477888 | A | 3/1989 |
| JP | 349183 | A | 3/1991 |
| JP | 3261090 | A | 11/1991 |
| JP | 4212280 | A | 8/1992 |
| JP | 20094232 | A | 1/2009 |
| JP | 2015138615 | A | 7/2015 |
| WO | WO-2017084841 | A1 * | 5/2017 |

* cited by examiner

FLEXIBLE RESISTOR

CROSS-REFERENCE TO RELATED APPLICATIONS

This application claims priority to PCT application no. PCT/IB2018/054308, filed Jun. 13, 2018, which claims priority to Italian application no. 102017000065507, filed Jun. 13, 2017, the contents of which are incorporated by reference in their entireties.

FIELD OF THE INVENTION

The present invention relates to a resistor, in particular to a flexible resistor, to a manufacturing process thereof and to a tank provided with the resistor.

BACKGROUND ART

It is often necessary to heat a liquid contained in a tank. For example, new fuel-saving and pollution-abatement technologies in the automotive field, such as "water injection" technology, include the use of a tank containing water or an aqueous solution. Such technical solutions imply problems when the water temperature reaches 0° C. or, if an aqueous solution is provided, when the latter reaches lower temperatures.

At such temperatures, the fluid freezes and must be thawed quickly and in precise quantities because it is necessary for the operation of the systems in the motor vehicle.

Systems with excessive power concentration cannot be used to thaw large quantities of frozen mass, e.g. ice, because excessive overheating causes the ice to pass directly into the gas phase. This implies that the gas layer does not allow an effective thawing of the remaining part of ice. Additionally, the system requires liquid and not gas, which could compromise the system itself.

The need is therefore felt to be able to heat a liquid, in particular a frozen liquid, in a tank quickly and reliably.

SUMMARY OF THE INVENTION

It is an object of the present invention to provide a resistor, particularly a flexible resistor, capable of effectively and rapidly thawing a liquid contained in a tank.

It is another object of the present invention to provide a resistor which allows the optimal diffusion of heat.

It is another object of the present invention to provide a resistor which allows the diffusion of heat by conduction as much as possible.

The present invention achieves these and other objects which will become apparent from the present description by providing a flexible resistor or electric heater comprising a support made of electrically insulating material; at least one track made of electrically conductive material incorporated in the support, adapted to be connected to an electric energy source; a foil made of electrically conductive material, having a surface fixed to a first face of the support, and a plurality of wings defined by foil portions cut and folded transversally to said surface.

According to an aspect, the invention further provides a tank comprising a least one flexible resistor as defined above, wherein a second face of the support, opposite to the first face, is fixed to an inner wall of the tank, preferably said inner wall being a bottom wall of the tank; and wherein each wing of said plurality of wings, defined by foil portions cut and folded transversally to said surface, extends towards the interior of the tank.

According to a further aspect, the invention provides a process for obtaining a flexible resistor as defined above, the process comprising the following steps:

a) incorporating the at least one track made of electrically conducting material into the support, b) fixing the surface of the foil to the support, wherein the provision of the plurality of wings of the foil by cutting a plurality of foil portions and folding said foil portions transversally to said surface is carried out either before or after step b).

Thus, a resistor according to the invention advantageously comprises a foil, or sheet, of thermally conductive material, e.g. metal such as aluminum, having folded wings. When the resistor is fixed to an inner wall of the tank, the wings are folded towards the inside of the tank. More specifically, the wings are cut directly from the foil and folded in the direction of the mass to be thawed. In this manner, the heat is optimally distributed within the ice volume.

The resistor of the invention is preferably a flexible resistor.

The resistor of the invention also has the following advantages:

- The heat can be diffused as much as possible by conduction inside the frozen fluid volume and not only at a tank wall, e.g. the bottom; this aspect is particularly advantageous in view of the fact that conduction heating is more efficient and effective, particularly in terms of speed, with respect to convection and radiation, in order to achieve rapid thawing.
- It is possible to increase the specific power on the electrically insulating support as the support exchanges heat with the thermally conductive foil.
- The heating area is larger.
- It implies a lower number of rejects during the production process.
- It is particularly adapted for operating on a frozen fluid subject to various freezing and thawing cycles.
- It is particularly resistant to mechanical stress, in particular to shocks and vibrations.
- It is capable of operating at a voltage supplied to the car battery, for example at about 13 V.

Preferably, the resistor comprises a plurality of tracks made of electrically conductive material, adapted to be electrically connected in parallel to one another. In this manner, even if one or more conductive tracks fail to work, heating can be obtained from the other tracks. This is particularly advantageous in view of the fact that components used in the automotive field are particularly subject to mechanical and thermal stress.

According to an embodiment, to each wing corresponds an opening in the surface of the foil, below which there is the electrically insulating support.

According to another embodiment, to each wing it is attached a respective electrically insulating support portion in which a respective portion of the at least one track is embedded. Heat distribution is further improved in this manner.

Further features and advantages of the present invention will be more apparent in light of the detailed description of preferred, but not exclusive embodiments.

The dependent claims describe preferred embodiments of the invention.

BRIEF DESCRIPTION OF THE DRAWINGS

The description of the invention refers to the accompanying drawings, which are provided by way of non-limiting example, in which.

The same reference numerals in the figures identify the same members.

DETAILED DESCRIPTION OF EXEMPLARY EMBODIMENTS OF THE INVENTION

Figure 1:
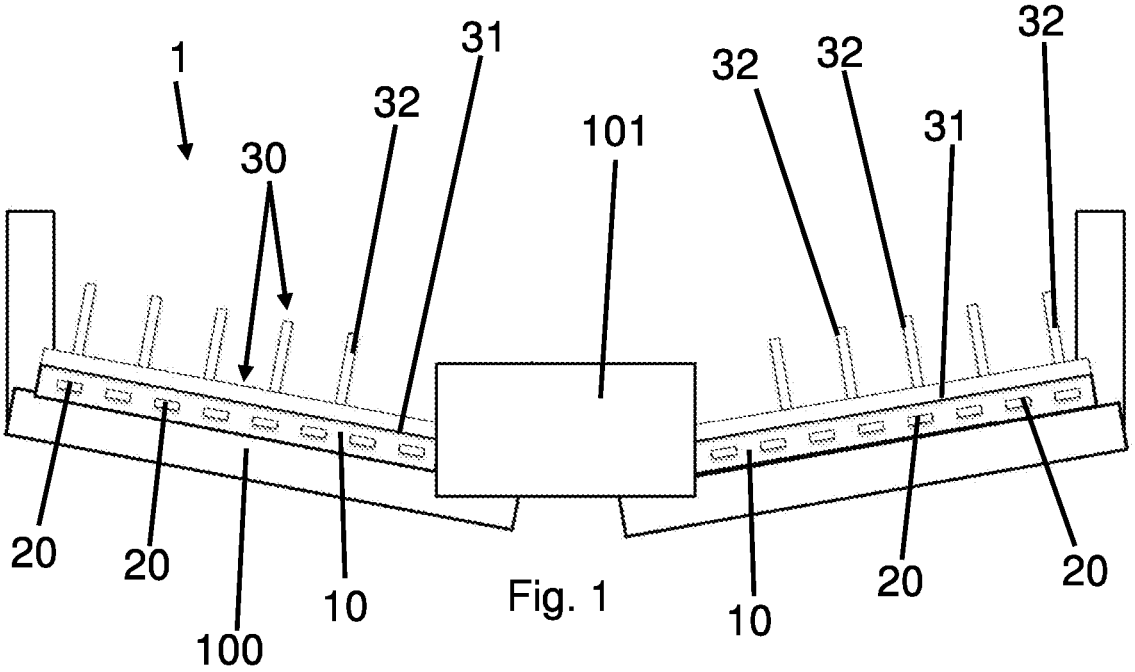
FIG. 1 diagrammatically shows a section view of the resistor fixed to a tank (partially illustrated)

A resistor 1 is shown in the figures comprising a support 10 made of electrically insulating material;

at least one track 20 made of electrically conductive material embedded in the support 10, adapted to be connected to an electric energy source;

a foil 30 made of electrically conductive material, having a surface 31 fixed to a first face of the support 10, and a plurality of wings 32 defined by foil portions cut and folded transversally to said surface 31.

The resistor 1 is substantially a heater, or heating element, in particular an electric heater. Typically, the resistor is a flexible resistor.

In the figures, the resistor 1 is shown together with a tank 100, which will be described later.

For example, the support 10 is made of a polymeric material, preferably silicone.

Alternatively, another suitable material is polypropylene.

The at least one track 20 made of electrically conductive material, or conductive track, is for example made of Aluminum, Constantan, Copper, German Silver, Steel, Inconel, Brass and the like.

Preferably, the conductive track 20 is made of aluminum.

Preferably, the conductive track 20 has a thickness comprised between 10 and 200 μm, e.g. between 15 and 150 μm.

Preferably, the conductive track 20 comprises one or more folds.

The source of electrical power to which the conductive track 20 can be connected is preferably the car battery (not shown), which typically operates at a voltage of about 13 V. The connection with the battery is made, for example, by means of end portions (not shown) of the conductive track 20 external to the support 10.

When the track 20 is crossed by current it heats up. As a result, there is a heating of the support 10, which in turn transfers heat to the foil 30, comprising the wings 32.

The foil 30 is preferably made of metal, preferably aluminum, which is a good heat conductor.

The foil 30 is fixed to one face of support 10, preferably to only one face the of support 10. In particular, the surface 31 is adherent to the surface 10.

The wings 32 are part of the foil 30, and in particular are folds of the foil 30. For example, the wings 32 form an angle preferably of about 90° with the respective surface portion 31 underneath.

Preferably, the thickness of the surface 31 is equal to the thickness of each wing 32, and preferably such thickness is equal to a value between 0.2 and 3 mm, e.g. between 0.3 and 2 mm.

According to the embodiment shown, to each wing 32 corresponds an opening of the surface 31 of the foil 30. The electrically insulating support 10 is located at each opening. In other words, the surface 31 has a plurality of openings, and each opening is associated with a respective wing 32.

Alternatively, according to an embodiment (not shown), to each wing is stuck, or fixed, a respective portion of the support 10 in which a corresponding portion of track 20 is embedded. Therefore, to each wing 32 corresponds a respective through opening of the resistor.

The resistor 1 can comprise either a single track 20 or a plurality of tracks 20. If a plurality of conductive tracks 20 is provided, they are adapted to be electrically connected in parallel to one another.

Optionally, in all embodiments, the resistor 1' can comprise at least one Positive Temperature Coefficient (PTC) element, also named PTC element, embedded in the support 10. By way of non-limiting example, the PTC element may be a further resistor or resistive element.

The at least one PTC element 59 is in electric contact, e.g. directly in contact, with one or more portions of track 20. The track 20 can electrically supply the at least one PTC element 59. Advantageously, the temperature self-adjusts during the heating of the PTC element 59. By exploiting self-regulation, it is possible to avoid the use of a dedicated electronic temperature control unit, in particular to control the temperature of the least one PTC element 59.

Preferably, but not exclusively, the at least one PTC element 59 is located between the track 20 and a layer of the support 10, preferably the layer of support to which the foil 30 is attached.

Optionally, a plurality of PTC elements is provided.

Figure 3:
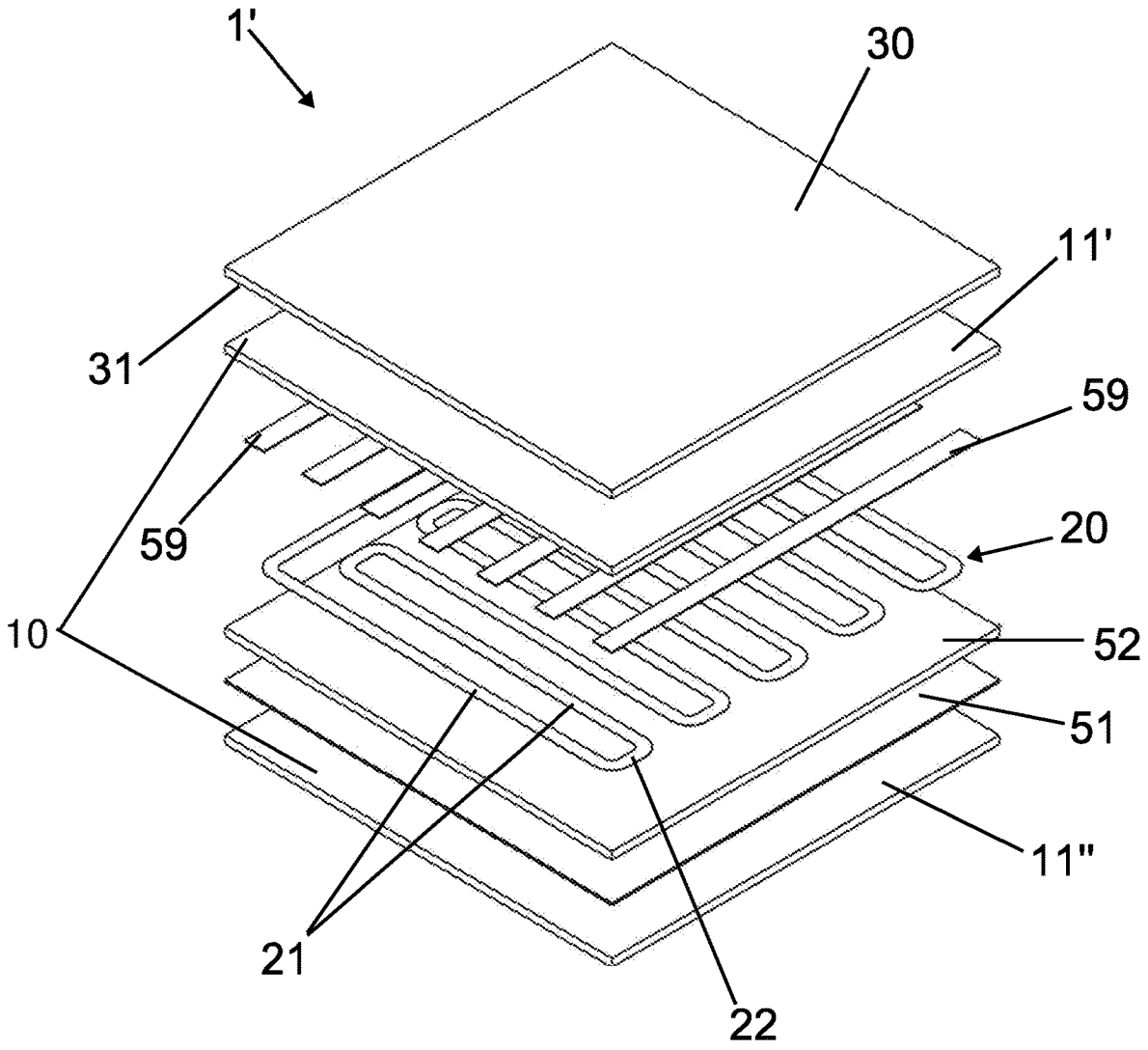
FIG. 3 shows a perspective exploded view of a particular embodiment of the invention.

FIG. 3 shows an example of a resistor 1' comprising a plurality of PTC elements 59.

According to the example in FIG. 3, the resistor 1' comprises two layers 11', 11", e.g. two foils, of electrically insulating material. The foils 11', 11" are fixed to each other to form the support 10.

The resistor 1' comprises a foil 30 made of thermally conductive material, preferably aluminum or a material made of aluminum. The foil 30 has a surface 31 fixed to one face of the support 10. In particular, the foil 30 is fixed to one face of the layer 11', in particular to the face which is distal from the conductive track 20.

Figure 2:
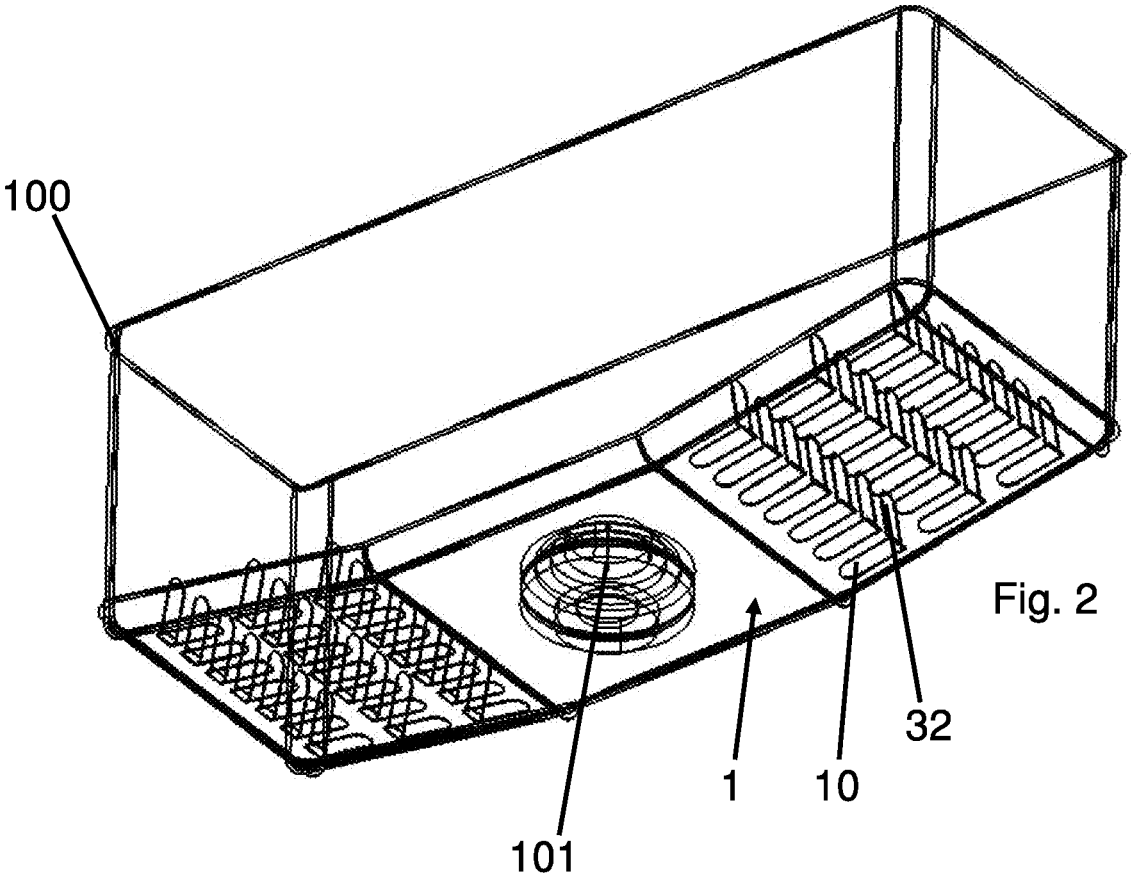
FIG. 2 shows a perspective view of a resistor fixed to the tank (partially illustrated)

The foil 30 comprises a plurality of wings—not shown in FIG. 3—defined by portions of foil cut and folded transversely to said surface 31, in a manner substantially analogous to that shown in FIGS. 1 and 2.

The following are embedded in the support 10, in particular arranged between the two layers 11', 11"; a foil 51 of electrically conductive material, e.g. copper or comprising copper; a layer 52 of electrically insulating material; the conductive track 20, preferably arranged substantially on one plane; a plurality of PTC elements 59, which are preferably mutually coplanar, i.e. arranged on the same plane.

Preferably the layer 11", the foil 51, the layer 52, the conductive track 20, the mutually coplanar PTC elements 59, the insulating layer 11' and the foil 30 are mutually in succession, substantially forming a sandwich structure, more preferably in mutually direct succession.

Preferably, but not exclusively, the conductive track 20 comprises a plurality of mutually substantially parallel stretches 21. Preferably, the stretches 21 are substantially rectilinear. The stretches 21 are preferably joined together by elbows or joints 22.

Preferably, the PTC elements 59 are mutually separated. Preferably, the PTC elements 59 each define a respective longitudinal axis, i.e. an axis along which the greatest extension of the PTC element 59 extends.

Preferably, the PTC elements 59 are mutually parallel, in particular so that their respective longitudinal axes are arranged substantially parallel to each other. Preferably, the longitudinal axes of the PTC elements 59 are substantially perpendicular to the stretches 21 of the conductive track 20. Preferably, each PTC element 59 is in electrical contact with more than one stretches 21.

The figures show part of a tank 100 provided with a resistor 1. In particular, a face of the support 10, opposite to the face onto which the foil 30 is fixed, is fixed to an inner wall of the tank 100. Preferably, such inner wall of the tank 100 is its back wall. Typically, the bottom wall of tank 100 has an opening with which a distribution module 101 is associated. A fluid pump (not shown) may be connected to the distribution module 101. Preferably, the resistor 1 surrounds the distribution module 101. Optionally, the central portion of the resistor 1 surrounds the distribution module. It is further preferable that this central portion is not provided with wings, while the two side portions, which extend from one side of the central portion, are provided with wings 32.

Preferably, there is direct contact between the face, or surface, of the support 10 and the inner wall of the tank. Preferably, and advantageously, there is a perfect adherence between the resistor 1 and the inner wall of the tank 100. The fastening of resistor 1 to the tank 100 is such that the wings 32 extend towards the inside of tank 100.

The container may also comprise more than one flexible resistor 1.

Preferably, a process for making a flexible resistor 1 according to the invention comprises the following steps:

a) embedding the at least one track 20 made of electrically conducting material into the support 10, b) fixing the surface 31 of the foil 30 to the support 10, wherein the plurality of wings 32 of the foil 30, by cutting a plurality of foil portions and folding said foil portions transversally to said surface 31, are made either before or after step b).

Preferably, in step a), two sheets of electrically insulating material, preferably silicone, are provided, between which the at least one electrically conductive track 20 is laid. Preferably, by fixing, e.g. by crosslinking, such sheets of electrically insulating material become substantially continuous, i.e. form a single element.

Optionally, in step b), if the support 30 is made of silicone, such fixing is preferably obtained by heating the support 10 and the sheet 30 by means of heating means so as to crosslink the support 10; alternatively, adhesive means may be used.

In an example, if the plurality of wings 32 is provided before step b), the following steps are provided between step a) and step b):

cutting the foil portions by means of cutting means;

folding said foil portions transversally to said first surface (31) to obtain the plurality of wings (32);

arranging the foil (30) on the support (10).

According to another example, if the provision of the wings 32 is carried out after step b), the following steps are included after step (b):

cutting foil portions 30 and support portions 10 by means of cutting means;

folding said foil and support portions transversally to said first surface 31 in order to obtain the plurality of wings 32, whereby a respective support portion 10, in which a respective portion of the at least one track 20 is embedded, adheres onto each wing.

The invention claimed is:

1. A flexible resistor comprising:

a support made of electrically insulating material;

at least one track made of electrically conductive material incorporated in the support, wherein the at least one track is adapted to be connected to an electric energy source;

a foil made of electrically conductive material, having a surface fixed to a first face of the support, and a plurality of wings defined by foil portions cut and folded transversally to said surface.

2. The flexible resistor according to claim 1, wherein the at least one track includes a plurality of tracks made of the electrically conductive material, adapted to be electrically connected in parallel to one another.

3. The flexible resistor according to claim 1, wherein the support is made of silicone.

4. The flexible resistor according to claim 1, wherein said foil is made of metal.

5. The flexible resistor according to claim 4, wherein the foil is made of aluminum.

6. The flexible resistor according to claim 1, wherein a respective portion of the support, in which a respective portion of the at least one track is incorporated, is fixed onto one or more wings of said plurality of wings.

7. The flexible resistor according to claim 1, further comprising a positive temperature coefficient element in electrical contact with the at least one track.

8. The flexible resistor according to claim 7, further comprising a plurality of positive temperature coefficient elements.

9. The flexible resistor according to claim 8, wherein each positive temperature coefficient element is in electrical contact with more than one portion of the at least one track.

10. The flexible resistor according to claim 7, wherein an electrically conducting material foil and/or an electrically insulating material layer are provided between the at least one track and the support.

11. A tank comprising at least one flexible resistor according to claim 1, wherein a second face of the support, opposite to the first face, is fixed to an inner wall of the tank; and wherein each wing of said plurality of wings, defined by foil portions cut and folded transversally to said surface, extends towards inside of the tank.

12. The tank according to claim 11, wherein said inner wall is a bottom wall of the tank.

13. A process for obtaining a flexible resistor according to claim 1, the process comprising the steps of:

a) incorporating the at least one track made of the electrically conducting material into the support; and b) fixing the surface of the foil to the support;

wherein provisioning of the plurality of wings of the foil by cutting a plurality of foil portions and folding said foil portions transversally to said surface is carried out either before or after step b).

14. The process according to claim 13, wherein if the provisioning of the plurality of wings is carried out before step b), the following steps are provided between step a) and step b):

cutting the foil portions;

folding said foil portions transversally to said surface to obtain the plurality of wings; and arranging the foil on the support.

15. A The process according to claim 13, wherein if the provisioning of the plurality of wings is carried out after step b), the following steps are provided after step b):

cutting foil portions and support portions with a cutter; and folding said foil and support portions transversally to said surface in order to obtain the plurality of wings, wherein a respective support portion, in which a respective portion of the at least one track is incorporated, is fixed onto each wing.

* * * * *